US005528783A

United States Patent [19]

Kunz et al.

[11] Patent Number: 5,528,783

[45] Date of Patent: Jun. 25, 1996

[54] INFLATABLE HEAD AND TORSO SUPPORT

[76] Inventors: Richard D. Kunz, 6667 S. 300 West, #4, Murray, Utah 84107; Dale O. Kelsch, 2657 E. Willowbend, Sandy, Utah 84093; Lamar C. Beynon, 168 S. 300 East, Washington, Utah 84780

[21] Appl. No.: 272,563

[22] Filed: Jul. 11, 1994

[51] Int. Cl.[6] ..... A47C 27/08; A47C 21/00

[52] U.S. Cl. ..... 5/634; 5/615; 5/644; 5/453

[58] Field of Search ..... 5/615, 644, 634, 5/453, 449, 654, 648, 456; 297/DIG. 3

[56] References Cited

U.S. PATENT DOCUMENTS

| | | | |
|---|---|---|---|
| 1,772,310 | 8/1930 | Hart | 5/453 |
| 2,612,645 | 10/1952 | Boland | 5/644 |
| 3,392,412 | 7/1968 | Aymar | 5/634 |
| 3,533,113 | 10/1970 | Stamberger | 5/654 |
| 3,606,623 | 9/1971 | Aymar | 5/634 |
| 3,667,075 | 6/1972 | Ballard et al. | 5/615 |
| 4,542,547 | 9/1985 | Sato | 5/453 |
| 4,873,731 | 10/1989 | Williamson | 5/615 |
| 4,941,221 | 7/1990 | Kanzler | 5/615 |
| 5,184,365 | 2/1993 | Stafford | 5/632 |
| 5,311,625 | 5/1994 | Barker et al. | 5/615 |
| 5,345,630 | 9/1995 | Healy | 5/634 |

FOREIGN PATENT DOCUMENTS

| | | | |
|---|---|---|---|
| 1422606 | 11/1965 | France | 5/615 |
| 6431128 | 5/1984 | Switzerland | 5/644 |
| 2106779 | 4/1983 | United Kingdom | 5/454 |

*Primary Examiner*—Alexander Grosz
*Attorney, Agent, or Firm*—J. David Nelson

[57] ABSTRACT

A device for the positioning and support of the head or the head and torso of a person in a supine or reclined position. This device consists of a wedge shaped inflatable air bladder, a source of pressurized air, and air hose and valves for the controlled inflation and deflation of the air bladder. The air bladder is preferably constructed of heavy duty rubber or other resilient material and has joints of soft rubber or other soft resilient material along the front and back edges of the base, along the apex, and along the middle of the back wall of the air bladder, to provide for the predictable and compact folding of the air bladder in deflation. There is also a sheet of resilient material extending forward from the base of the air bladder, upon which the user's weight is superimposed during use, thereby preventing the device from slipping away from the user. The air bladder may be fully inflated, partially inflated or fully deflated as desired by the user, to incline the head or the head and torso, depending upon the size of the air bladder, of the user to the desired position.

11 Claims, 2 Drawing Sheets

INFLATABLE HEAD AND TORSO SUPPORT

FIELD OF THE INVENTION

This invention relates to inflatable cushions and body support and positioning devices, and, in particular, to inflatable cushions and support and positioning devices for the head and torso.

BACKGROUND OF THE INVENTION

Mechanical means for supporting or positioning the head, torso, or other parts of a person's body while in bed or otherwise in a supine or reclined position are well known. Such devices include means for deforming a hospital bed which are electric motor driven. Also, inflatable means for the support and comfort of various parts of the body of a person in the supine or reclined position are disclosed in U.S. Pat. No. 4,979,249 to Meade, U.S. Pat. No. 4,768,247 to Beier, U.S. Pat. No. 4,161,794 to Darnfors, U.S. Pat. No. 4,142,263 to Pierson and U.S. Pat. No. 4,133,064 to Petrusek.

Several other inflatable or pneumatically operated devices have been developed for the positioning of the handicapped or otherwise physically limited persons. U.S. Pat. No. 3,848,274 to Oliver discloses an inflatable bed pan. U.S. Pat. No. 3,803,645 to Oliverius discloses an inflatable device for positioning and support of the feet or legs of a handicapped person.

U.S. Pat. No. 4,629,162 to Porche discloses an inflatable cushion for assisting a handicapped person in moving from a standing position to a seated position in a chair and returning from the seated position to a standing position. A similar device employing a ring-shaped inflatable cushion is disclosed in U.S. Pat. No. 4,905,329 to Heilner. U.S. Pat. No. 3,250,569 to Gaffney, U.S. Pat. No. 3,479,086 to Sheridan, and U.S. Pat. No. 3,479,087 to Burke disclose similar devices which are partially pneumatically and partially mechanically actuated.

U.S. Pat. No. 5,020,168 to Wood discloses an inflatable chair for use in bathing handicapped persons in a bathtub.

Mechanical means for support and positioning of the head and torso, such as that employed in hospital beds, have generally been highly mechanized and expensive. Further, such means are generally of limited portability. While the inflatable cushions and supports disclosed by the patents identified above provide for some positioning and comfort at a much lower cost than a hospital bed and other mechanical means, and provide for portability and transferability, the function of the inflatable cushions and supports is substantially more limited.

It is an object of the present invention to provide an economical and portable device for comfortably positioning and supporting the head and torso of a person in a supine or reclined position.

Another object of the present invention is to provide a device for positioning and supporting the head and torso which offers a variety of positioning and support configurations.

A further object of the present invention is to provide a device which will assist a physically limited person in getting out of bed.

A further object of the present invention is to provide a device which is easy and inexpensive to operate, maintain and repair.

A further object of the present invention is to provide a device which can be operated by the user or an assisting person from the use position.

SUMMARY OF THE INVENTION

The present invention provides an inflatable support for use by a person in bed or more generally by a person in a supine or reclined position. Depending upon the dimension selected for the device, the device can be deployed in the size which is suitable for positioning and supporting the head or in a size for positioning and supporting the torso and the head. If sized for the torso and the head, the device can also be used to assist the user in getting out of bed. The device can be multi-chambered and controlled by separate valves, which would allow for some independent adjusting of the support for the head and torso, or can be single chambered providing for support positioning of the head or of the head and torso together.

The device consists of an air bladder with one or more chambers; a pressurized air supply to each chamber controlled by one or more valves which are each actuated by inflation control switches accessible to the user or an assisting person while in the use position; one or more deflation valves, also actuated by a control switch, providing for the total or partial deflation of the device or any of its chambers, as the case may be. The source of pressurized air for the device can be a standard low pressure compressor or blower. The device is preferably constructed of rubber or other resilient material and is constructed with soft collapse joints providing for the predictable and reproducible collapse of the air bladder to a comfortable and compact position as it is deflated. The air bladder can be retained in its inflated configuration until the time of the next desired use or it can be deflated and retained in place where it will be relatively unobstructive for the other users of the bed who do not require assistance. The device also can be removed and transported to other beds at home or to other user locations. For example, persons providing home assistance to handicapped persons may utilize the same device at a number of locations. Likewise, retirement centers or nursing homes may utilize the device at a number of locations, or may make the device available for use by residents.

DETAILED DESCRIPTION OF THE PREFERRED EMBODIMENTS

Figure 1:
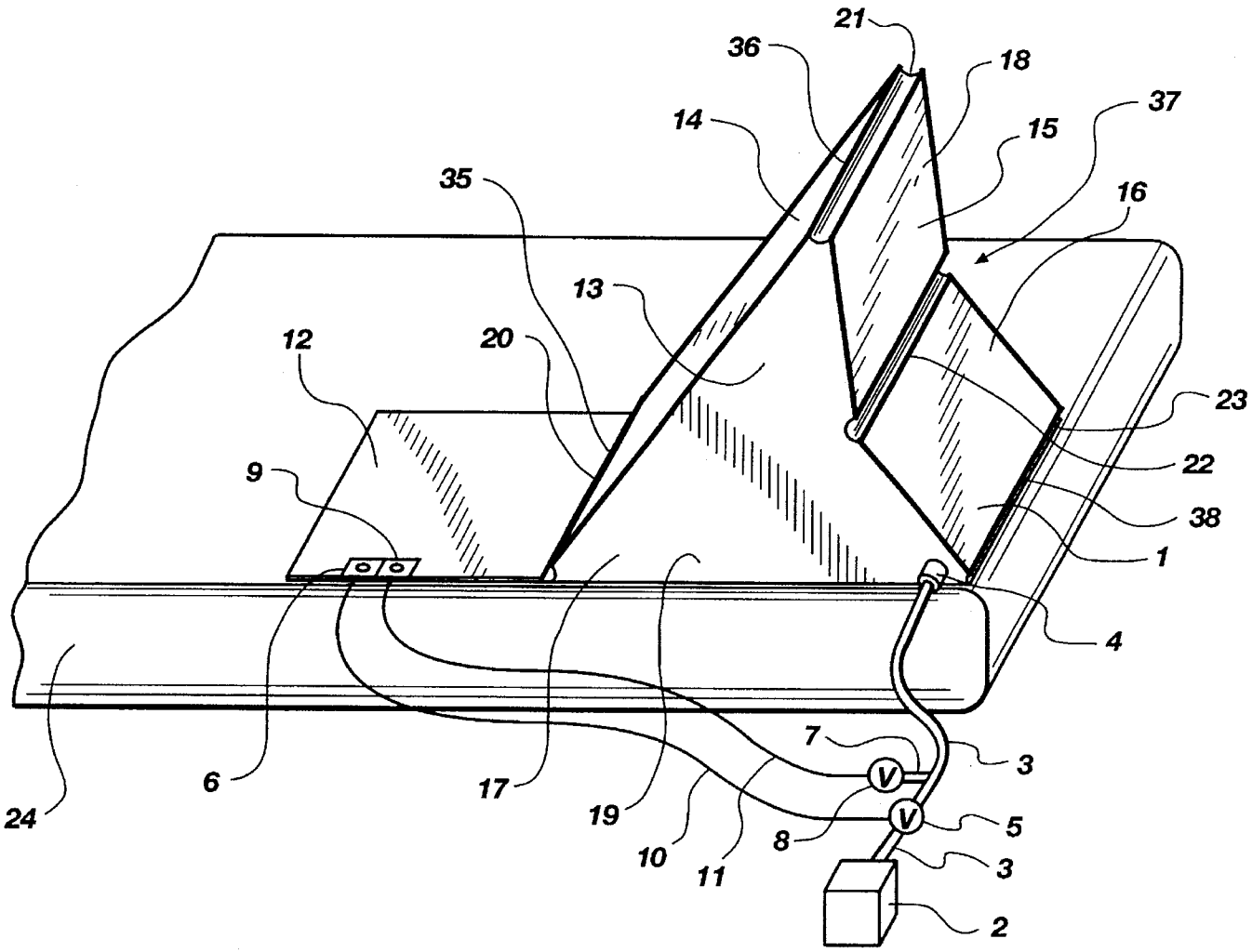
FIG. 1: A perspective of the head and torso support device in a fully inflated configuration.
Figure 4:
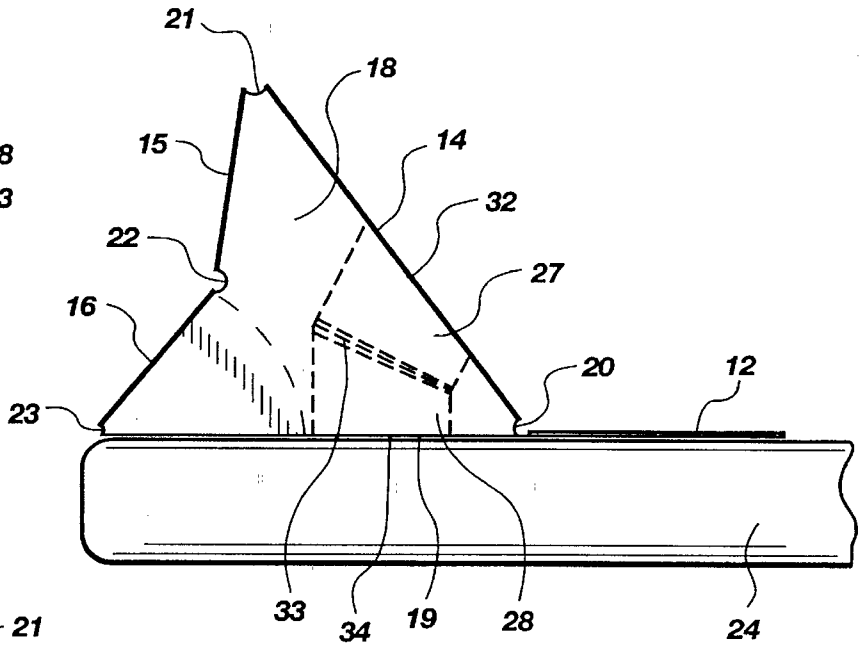
FIG. 4: A cross section detail of the head and torso support device in a partially inflated configuration.

A preferred embodiment of the inflatable head and torso support device, which is shown generally in FIG. 1, comprises an inflatable air bladder 1, an air supply 2, a hose coupling 4, an inflation hose 3, an inflation valve 5, an inflation switch 6, a deflation hose 7, a deflation valve 8, a deflation switch 9, an inflation air control line 10, a deflation air control line 11, and an anchor sheet 12.

Under a preferred embodiment, the air bladder 1 has a single chamber 13, comprised of a support wall 14, a top rear wall 15, a bottom rear wall 16, a left end wall 17, a right end wall 18, and a base wall 19. Under a preferred embodiment, the support wall, the top rear wall, the bottom rear wall, the base wall, and the anchor sheet are molded of heavy duty rubber and the left end wall and right end wall are constructed of soft rubber. However, other embodiments may provide that air bladder and the anchor sheet are constructed of any resilient material.

Under a preferred embodiment, the support wall and the base wall are connected together and to the anchor sheet 12 by a soft rubber collapse joint 20, the front base collapse joint which extends across the front edge 35 of the base. The support wall is connected at the apex 36 of the air bladder to the top rear wall by a soft rubber collapse joint 21, the top collapse joint, which extends across the apex of the air bladder. Likewise, the bottom rear wall is connected in the back 37 of the air bladder to the top rear wall by a soft rubber collapse joint 22, the rear wall collapse joint, which extends across the back of the air bladder. Also, the bottom rear wall is connected at the rear edge 38 of the base to the base wall by a soft rubber collapse joint 23, the rear base collapse joint, which extends across the rear edge of the base.

Under a preferred embodiment, the support wall is sized for the positioning and support of the head and the torso of the user. Under this embodiment, the dimension of the support wall from the front base collapse joint 20 to the top collapse joint 21 is preferably at least as long as the dimension from the hip joint to the top of the head of the user. Under another embodiment, the air bladder 1 may be multi-chambered allowing for some independent positioning of the head and the torso of the user. Under another preferred embodiment, the air bladder is sized for the positioning and support of the head of the user only. Under this embodiment, the dimension of the support wall from the base wall to the top rear wall is preferably at least as long as the dimension from the shoulder to the top of the head of the user. Various embodiments of the invention may provide for various sizes for the support wall and the top and bottom back walls to better accommodate various size of users.

Figure 2:
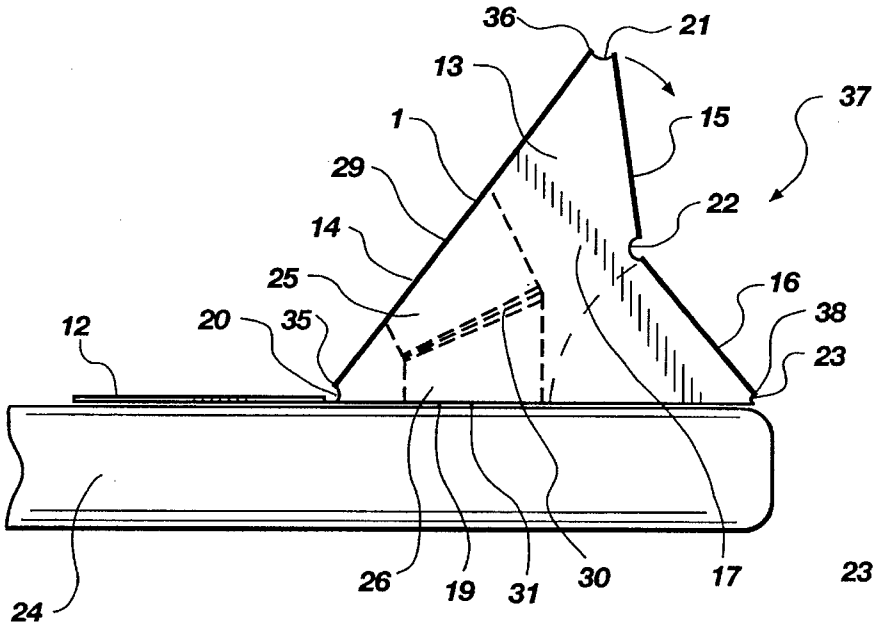
FIG. 2: A cross section detail of the head and torso support device in a partially inflated configuration.

Referring to FIG. 2, in a preferred embodiment, the form of the air bladder as it is inflated or deflated to various configurations is maintained through the use of heavy duty rubber or other resilient material for the support wall, the top rear wall, the bottom rear wall, and the base, and through the use of the collapse joints 20, 21, 22 and 23. Counterclockwise and clockwise rotation of the support wall with various degrees of inflation is allowed by the front base collapse joint 20 where the support wall joins the anchor sheet and the base wall. Under a preferred embodiment, the left end wall 17 and right end wall 18 are constructed of soft rubber, allowing for the predictable and compact deflation of the air bag by folding the air bladder at the collapse joints 21, 22 and 23.

Figure 3:
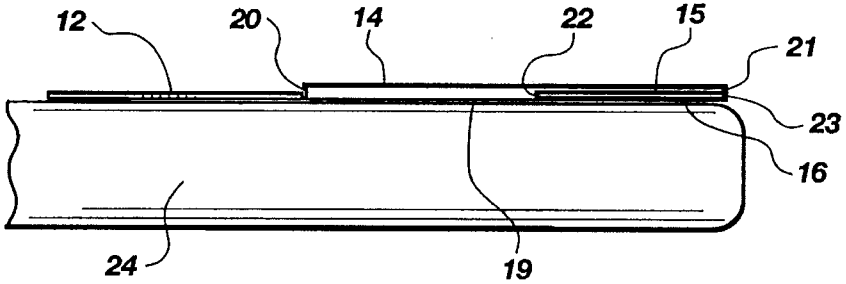
FIG. 3: A cross section of the head and torso support device in a fully deflated configuration.

Referring to FIG. 3, in the fully deflated configuration the bottom rear wall 16 folds onto the base wall 19, the top rear wall 15 folds onto the bottom rear wall 16 and the support wall 14 folds onto the top rear wall 15 and the base wall 12. Under a preferred embodiment, the dimension of the support wall from the front base collapse joint 20 to the top collapse joint 21 is approximately equal to the dimension of the base wall from the front base collapse joint to the rear base collapse joint 23. Also, the dimension of the top rear wall from the rear wall collapse joint 22 to the top collapse joint 21 and the dimension of the bottom rear wall from the rear base collapse joint 23 to the rear wall collapse joint 22 are approximately equal and are each are approximately equal to 0.7 times the dimension of the support wall from the front base collapse joint to the top collapse joint. This permits the walls to fold flat as shown in FIG. 3 when the air bladder is fully deflated and to have the support wall, with various degrees of inflation, serve at any angle with the horizontal between zero and ninety degrees. Obviously the preferred dimensions are not the only dimensions that will permit the walls to fold flat in complete deflation. Also, service of the support wall at an angle greater than forty-five degrees with the horizontal may be desired for some users. There are only two requirements for the air bladder to fold flat in deflation. One is that the dimension of the support wall from the front base collapse joint to the top collapse joint is approximately equal to the dimension of the base wall from the front base collapse joint to the rear base collapse joint, plus the amount that the dimension of the top rear wall exceeds the dimension of the bottom rear wall or less the amount that the dimension of the bottom rear wall exceeds the dimension of the top rear wall. The other is that the dimension of the bottom rear wall must be less than the dimension of the base wall and the dimension of the top rear wall must be less than the dimension of the support wall.

Under preferred embodiments of the invention, the left end wall and the right end wall are constructed of soft rubber or other resilient material, except for a left top stiffener panel 25, a left bottom stiffener panel 26, a right top stiffener panel 27 and a right bottom stiffener panel 28. These stiffener panels are preferably constructed of heavy duty rubber or resilient material. The left top stiffener panel is attached to the support wall 14 by the soft rubber left top stiffener collapse joint 29 and to the left bottom stiffener panel by a left stiffener collapse joint 30. The left bottom stiffener panel is attached to the base wall by the left bottom stiffener collapse joint 31.

The right top stiffener panel is attached to the support wall by the soft rubber right top stiffener collapse joint 32 and to the right bottom stiffener panel by a right stiffener collapse joint 33. The right bottom stiffener panel is attached to the base wall by the right bottom stiffener collapse joint 34. As the air bladder is deflated, the right top stiffener panel folds upon the right bottom stiffener panel, thereby promoting the compact folding of the right end wall. Likewise, as the air bladder is deflated, the left top stiffener panel folds upon the left bottom stiffener panel, thereby promoting the compact folding of the left end wall.

Under preferred embodiments of the invention, separate cushions or pillows may be used with the present invention to provide additional comfort to the user. Other embodiments may provide for integral or detachable cushions affixed to the support wall and the anchor sheet.

Under a preferred embodiment, the user operates the device by actuating the inflation switch 6 which opens the inflation valve 5 allowing air from the air supply 2 to travel through the inflation hose 3 to the air hose coupling 4 and into the air bladder 1. The user adds the amount of air necessary to achieve the desired degree of inflation for the desired support position, and then the inflation valve is closed by deactuating the inflation switch. When the user desires a lesser degree of inflation, the deflation switch 9 is actuated, opening the deflation valve and allowing air to travel from the air bladder through inflation hose to the deflation hose 7 and the deflation valve, thereby releasing air until the desired degree of inflation is attained. Then the deflation switch is deactuated, closing the deflation valve.

Under a preferred embodiment, the inflation and deflation switches are hand actuated by the user or an assisting person.

Under other preferred embodiment, the switches may be foot actuated by the user, if the user is not physically able to actuate the device by hand, or may foot actuated by an assisting person, thereby freeing up both hands for the assisting person to use in assisting the user.

The air hose 3 can be any of the commonly used and readily available low pressure air hose or tubing. Likewise, the hose coupling 4 can be any of a number of commonly available air connections or coupling devices. Under other embodiments of the invention, the air bladder may be equipped with an integral valve stem similar to that used for a tire tube.

Under a preferred embodiment, the dimension of the air bladder from the left end wall 17 to the right end wall 18, and the corresponding width of the anchor sheet is approximately one half the width of a full size mattress 24. With this dimension, the device may be used on a twin bed, full size bed or any larger size beds, and when it is used on a full size bed or larger, the use of the device will not inhibit the use of the remaining sleeping area by another person. However, other embodiments may provide for a narrower or wider air bladder and anchor sheet as desired by the user. Also, although under the preferred embodiments the support wall, the top rear wall, the bottom rear wall, the base wall and the anchor sheet are rectangular shaped, various other shapes could be utilized.

Under preferred embodiments of the invention, the air source 2 is a mechanized air source such as a low pressure compressor or blower. However, other embodiments may use a hand pump or other manual air source. In hospital or other institutional settings the invention can be connected to a common air supply.

To enhance the portability of the air bladder and anchor sheet, embodiments of the invention may provide one or more fixed or detachable handles and may provide snaps or other devices to secure the support wall, the base wall and the anchor sheet together in a deflated and compact configuration for transport.

Other embodiments of the invention and other variations and modifications of the embodiments described above would be obvious to a person skilled in the art. Therefore, the foregoing is intended to be merely illustrative of the invention and the invention is limited only by the following claims.

What is claimed is:

1. An inflatable support device comprising:

a) a wedge shaped air bladder having a rectangular shaped support wall at the front of said air bladder, a rectangular shaped base wall at the bottom of said air bladder, a rectangular shaped top rear wall and a rectangular shaped bottom rear wall at the back of said air bladder, a triangular shaped left end wall at the left end of said air bladder, and a triangular shaped right end wall at the right end of said air bladder; and having a front base collapse joint along the front edge of the air bladder between the support wall and the base wall, a top collapse joint along the apex between the support wall and the top rear wall, a rear collapse joint across the back between the top rear wall and the bottom rear wall, and a rear base collapse joint along the rear edge of the air bladder between the bottom rear wall and the base wall, thereby providing for predictable and compact collapse of the air bladder in deflation;

b) an anchor sheet connecting to and extending forward from the front base collapse joint;

c) an air inlet to the air bladder;

d) inflation air hose;

e) an inflation air hose coupling for connecting the air inlet to the inflation air hose;

f) an inflation air valve;

g) an inflation air valve control switch;

h) a pressurized air supply;

i) an air outlet from the air bladder;

j) deflation air hose;

k) a deflation air hose coupling for connecting the air outlet to the deflation air hose;

l) a deflation air valve;

m) a deflation air valve control switch.

2. An inflatable support device as claimed in claim 1 wherein the support wall, the base wall, the top rear wall, and the bottom rear wall are constructed of heavy duty resilient material; the left end wall and the right end wall are constructed of soft resilient material; and the front base collapse joint, the rear base collapse joint, the top collapse joint, and the rear collapse joint are constructed of soft resilient material.

3. An inflatable support device as claimed in claim 1 wherein the support wall, the base wall, the top rear wall, and the bottom rear wall are constructed of heavy duty rubber; the left end wall and the right end wall are constructed of soft rubber; and the front base collapse joint, the rear base collapse joint, the top collapse joint, and the rear collapse joint are constructed of soft rubber.

4. An inflatable support device as claimed in claim 1 wherein the left end wall has a left top stiffener panel and a left bottom stiffener panel constructed of heavy duty resilient material and the right end wall has a right top stiffener panel and a right bottom stiffener panel constructed of heavy duty resilient material, said left top stiffener panel being attached to the support wall by a left top stiffener collapse joint and to the left bottom stiffener panel by a left stiffener collapse joint, and the left bottom stiffener panel is attached to the base wall by a left bottom stiffener collapse joint, and said right top stiffener panel being attached to the support wall by a right top stiffener collapse joint and to the right bottom stiffener panel by a right stiffener collapse joint, and the right bottom stiffener panel is attached to the base wall by a right bottom stiffener collapse joint, said collapse joints being constructed of soft resilient material, and said stiffener panels providing for the compact folding of the left and right end walls.

5. An inflatable support device as claimed in claim 1 wherein the left end wall has a left top stiffener panel and a left bottom stiffener panel constructed of heavy duty rubber and the right end wall has a right top stiffener panel and a right bottom stiffener panel constructed of heavy duty rubber, said left top stiffener panel being attached to the support wall by a left top stiffener collapse joint and to the left bottom stiffener panel by a left stiffener collapse joint, and the left bottom stiffener panel is attached to the base wall by a left bottom stiffener collapse joint, and said right top stiffener panel being attached to the support wall by a right top stiffener collapse joint and to the right bottom stiffener panel by a right stiffener collapse joint, and the right bottom stiffener panel is attached to the base wall by a right bottom stiffener collapse joint, said collapse joints being constructed of soft rubber, and said stiffener panels providing for the compact folding of the left and right end walls.

6. An inflatable support device as claimed in claim 1 wherein the air inlet and the air outlet are common, the inflation air hose coupling and the deflation air hose coupling are common, a portion of the inflation air hose and the deflation air hose are a common hose, and deflation air hose is connected to the common hose between the air inlet and the inflation air valve.

7. An inflatable support device comprising:

a) a wedge shaped air bladder having a rectangular shaped support wall at the front of said air bladder, a rectangular shaped base wall at the bottom of said air bladder, a rectangular shaped top rear wall and a rectangular shaped bottom rear wall at the back of said air bladder, a triangular shaped left end wall at the left end of said air bladder, and a triangular shaped right end wall at the right end of said air bladder; and having a front base collapse joint along the front edge of the air bladder between the support wall and the base wall, a top collapse joint along the apex between the support wall and the top rear wall, a rear collapse joint across the back between the top rear wall and the bottom rear wall, and a rear base collapse joint along the rear edge of the air bladder between the bottom rear wall and the base wall, thereby providing for predictable and compact collapse of the air bladder in deflation;

b) an anchor sheet connecting to and extending forward from the front base collapse joint;

c) an air inlet to the air bladder;

d) inflation air hose;

e) an inflation air hose coupling for connecting the air inlet to the inflation air hose;

f) an inflation air valve;

g) an inflation air valve control switch;

h) a pressurized air supply;

i) deflation air hose;

j) a deflation air hose coupling for connecting the deflation air hose to the inflation air hose between the air inlet and the inflation air valve;

k) a deflation air valve; and l) a deflation air valve control switch.

8. An inflatable support device as claimed in claim 7 wherein the support wall, the base wall, the top rear wall, and the bottom rear wall are constructed of heavy duty resilient material; the left end wall and the right end wall are constructed of soft resilient material; and the front base collapse joint, the rear base collapse joint, the top collapse joint, and the rear collapse joint are constructed of soft resilient material.

9. An inflatable support device as claimed in claim 7 wherein the support wall, the base wall, the top rear wall, and the bottom rear wall are constructed of heavy duty rubber; the left end wall and the right end wall are constructed of soft rubber; and the front base collapse joint, the rear base collapse joint, the top collapse joint, and the rear collapse joint are constructed of soft rubber.

10. An inflatable support device as claimed in claim 7 wherein the left end wall has a left top stiffener panel and a left bottom stiffener panel constructed of heavy duty resilient material and the right end wall has a right top stiffener panel and a right bottom stiffener panel constructed of heavy duty resilient material, said left top stiffener panel being attached to the support wall by a left top stiffener collapse joint and to the left bottom stiffener panel by a left stiffener collapse joint, and the left bottom stiffener panel is attached to the base wall by a left bottom stiffener collapse joint, and said right top stiffener panel being attached to the support wall by a right top stiffener collapse joint and to the right bottom stiffener panel by a right stiffener collapse joint, and the right bottom stiffener panel is attached to the base wall by a right bottom stiffener collapse joint, said collapse joints being constructed of soft resilient material, and said stiffener panels providing for the compact folding of the left and right end walls.

11. An inflatable support device as claimed in claim 7 wherein the left end wall has a left top stiffener panel and a left bottom stiffener panel constructed of heavy duty rubber and the right end wall has a right top stiffener panel and a right bottom stiffener panel constructed of heavy duty rubber, said left top stiffener panel being attached to the support wall by a left top stiffener collapse joint and to the left bottom stiffener panel by a left stiffener collapse joint, and the left bottom stiffener panel is attached to the base wall by a left bottom stiffener collapse joint, and said right top stiffener panel being attached to the support wall by a right top stiffener collapse joint and to the right bottom stiffener panel by a right stiffener collapse joint, and the right bottom stiffener panel is attached to the base wall by a right bottom stiffener collapse joint, said collapse joints being constructed of soft rubber, and said stiffener panels providing for the compact folding of the left and right end walls.

* * * * *